US007806651B2

(12) United States Patent
Kennepohl et al.

(10) Patent No.: US 7,806,651 B2
(45) Date of Patent: Oct. 5, 2010

(54) METHOD FOR DESIGNING A LOW-PRESSURE TURBINE OF AN AIRCRAFT ENGINE, AND LOW-PRESSURE TURBINE

(75) Inventors: Fritz Kennepohl, Unterschleissheim (DE); Detlef Korte, Munich (DE)

(73) Assignee: MTU Aero Engines GmbH, Munich (DE)

( * ) Notice: Subject to any disclaimer, the term of this patent is extended or adjusted under 35 U.S.C. 154(b) by 771 days.

(21) Appl. No.: 11/547,581

(22) PCT Filed: Mar. 11, 2005

(86) PCT No.: PCT/DE2005/000435

§ 371 (c)(1),
(2), (4) Date: Jun. 25, 2007

(87) PCT Pub. No.: WO2005/100750

PCT Pub. Date: Oct. 27, 2005

(65) Prior Publication Data

US 2008/0022691 A1 Jan. 31, 2008

(30) Foreign Application Priority Data

Apr. 2, 2004 (DE) ..... 10 2004 016 246

(51) Int. Cl.
*F01D 25/00* (2006.01)

(52) U.S. Cl. ..... 415/119; 415/199.5

(58) Field of Classification Search ..... 415/119, 415/199.5

See application file for complete search history.

(56) References Cited

U.S. PATENT DOCUMENTS

| | | | | |
|---|---|---|---|---|
| 3,194,487 | A | 7/1965 | Tyler | 230/122 |
| 3,270,953 | A | 9/1966 | Jerie et al. | 230/120 |
| 5,169,288 | A | 12/1992 | Gliebe et al. | 415/119 |
| 5,478,199 | A * | 12/1995 | Gliebe | 415/119 |
| 6,409,469 | B1 * | 6/2002 | Tse | 415/119 |
| 6,439,840 | B1 * | 8/2002 | Tse | 415/119 |

FOREIGN PATENT DOCUMENTS

| | | |
|---|---|---|
| DE | 14 76 877 | 2/1970 |
| DE | 42 28 918 | 3/1993 |
| GB | 1072145 | 6/1967 |

* cited by examiner

*Primary Examiner*—Ninh H Nguyen
(74) *Attorney, Agent, or Firm*—Davidson, Davidson & Kappel, LLC

(57) ABSTRACT

A low-pressure turbine of a gas turbine is disclosed. The turbine comprises a number of stages arranged one behind the other in an axial manner in the flow-through direction of the turbine. Each stage is formed from a fixed vane ring having a number of vanes and from a rotating blade ring having a number of blades. Each stage is characterized by a characteristic value vane-to-blade ratio that indicates the ratio of the number of vanes to the number of blades within a stage. One of the stages of the turbine is designed in such a manner that, in the event of noise-critical conditions of the turbine, the characteristic value vane-to-blade ratio of this stage is between a lower cut-off limit for mode k=−1 of the blade-passing frequency (BPF) of said stage and an upper cut-off limit for the mode k=−2 of the blade-passing frequency (BPF) of this stage.

13 Claims, 2 Drawing Sheets

METHOD FOR DESIGNING A LOW-PRESSURE TURBINE OF AN AIRCRAFT ENGINE, AND LOW-PRESSURE TURBINE

The present invention relates to a turbine, in particular a low-pressure turbine of a gas turbine, in particular of an aircraft engine.

BACKGROUND

Gas turbines, in particular aircraft engines, are made up of multiple subassemblies, namely among other things a compressor, preferably a low-pressure compressor and a high-pressure compressor, a combustion chamber, and at least one turbine, in particular a high-pressure turbine and a low-pressure turbine. The compressors and the turbines of the aircraft engine preferably include multiple stages which are positioned axially one behind the other in the flow direction. Each stage is formed by a stationary vane ring and a rotating blade ring, the stationary vane ring having multiple stationary guide vanes and the rotating blade ring having multiple rotating blades. Each stage is characterized by a characteristic quantity which indicates the number of guide vanes to the number of rotating blades ratio within the stage. This characteristic quantity is also referred to as the vane-to-blade ratio (V/B).

The low-pressure turbine of an aircraft engine in particular is a noise source not to be disregarded. The low-pressure turbine emits noises in particular at frequencies which are an integral multiple of the so-called blade-passing frequency (BPF). The blade-passing frequency of a stage is the frequency at which the rotating blades of the stage rotate past a stationary guide vane of the respective stage.

For minimizing the noise emission of the low-pressure turbine of an aircraft engine, it is known from the related art to establish the vane-to-blade ratio of downstream stages of the low-pressure turbine at a value of approximately 1.5 in order to muffle the noise of the blade-passing frequency. Despite these measures known from the related art, the low-pressure turbines of aircraft engines known from the related art still emit a high noise level under noise-critical operating conditions, in particular during the landing approach or during taxiing on the tarmac of an airport.

An object of the present invention is to create a novel turbine, in particular a low-pressure turbine of a gas turbine, in particular of an aircraft engine.

The present invention provides a turbine, in particular a low-pressure turbine of a gas turbine, in particular of an aircraft engine, having multiple stages positioned axially one behind the other in the flow direction of the turbine, each stage being formed by a stationary guide vane ring having multiple guide vanes and a rotating blade ring having multiple rotating blades, and each stage being characterized by a vane-to-blade ratio characteristic quantity which indicates the number of guide vanes to the number of rotating blades ratio within a stage. According to the present invention, at least one stage of the turbine is designed in such a way that its vane-to-blade ratio characteristic quantity under noise-critical operating conditions of the turbine is between a lower cut-off limit for mode k=−1 of the blade-passing frequency (BPF) of this stage and an upper cut-off limit for mode k=−2 of the blade-passing frequency (BPF) of this stage.

The design principle according to the present invention for a turbine of an aircraft engine makes it possible to noticeably minimize the noise level emitted by the turbine. The noise emission in the range of the blade-passing frequency (BPF) may be clearly reduced with the aid of the present invention.

According to a preferred refinement of the present invention, at least one of the stages of the turbine is designed in such a way that its vane-to-blade ratio characteristic quantity in noise-critical operating conditions of the turbine is between a lower cut-off limit for mode k=−1 of the double blade-passing frequency (2BPF) of this stage and an upper cut-off limit for mode k=−2 of the double blade-passing frequency (2BPF) of this stage.

With the aid of this preferred refinement of the present invention, it is also possible to minimize the noise emission with frequencies which correspond to the double blade-passing frequency.

According to another preferred refinement of the present invention, at least one of the stages of the turbine situated upstream in the flow direction is designed in such a way that its vane-to-blade ratio characteristic quantity under noise-critical operating conditions of the turbine is between a lower cut-off limit for mode k=−1 of the blade-passing frequency (BPF) of this stage and an upper cut-off limit for mode k=−2 of the blade-passing frequency (BPF) of this stage, and, furthermore, at least one of the stages of the turbine situated downstream in the flow direction is designed in such a way that its vane-to-blade ratio characteristic quantity under noise-critical operating conditions of the turbine is between a lower cut-off limit for mode k=−1 of the double blade-passing frequency (2BPF) of this stage and an upper cut-off limit for mode k=−2 of the double blade-passing frequency (2BPF) of this stage.

BRIEF DESCRIPTION OF THE DRAWING

Exemplary embodiments of the present invention are explained in greater detail on the basis of the drawing without being limited thereto.

DETAILED DESCRIPTION

The present invention is described in greater detail in the following with reference to FIGS. 1 and 2.

The present invention relates to a design principle for the stages of a turbine, namely a low-pressure turbine of an aircraft engine. Such a low-pressure turbine includes multiple stages which are situated axially behind each other in the flow direction of the low-pressure turbine. Each stage is formed by a stationary guide vane ring and a rotating blade ring. The guide vane ring has multiple stationary guide vanes. The rotating blade ring of each stage has multiple rotating blades. The present invention relates to a design principle with which the vane-to-blade ratio of the stages of a low-pressure turbine may be adapted in such a way that the low-pressure turbine emits a noise level as low as possible, i.e., under noise-critical operating conditions of the turbine or the aircraft engine. Such noise-critical operating conditions are, for example, a landing approach of an aircraft or movement of the aircraft on the tarmac of an airport. The noise emitted is characterized by frequencies which are integral multiples of the blade-passing frequency (BPF).

According to the present invention, at least one stage of the low-pressure turbine is designed in such a way that under noise-critical operating conditions of the turbine the vane-to-blade ratio (V/B) is between a lower cut-off limit for mode k=−1 of the blade-passing frequency (BPF) of this stage and an upper cut-off limit for mode k=−2 of the blade-passing frequency (BPF) of this stage.

Figure 1:
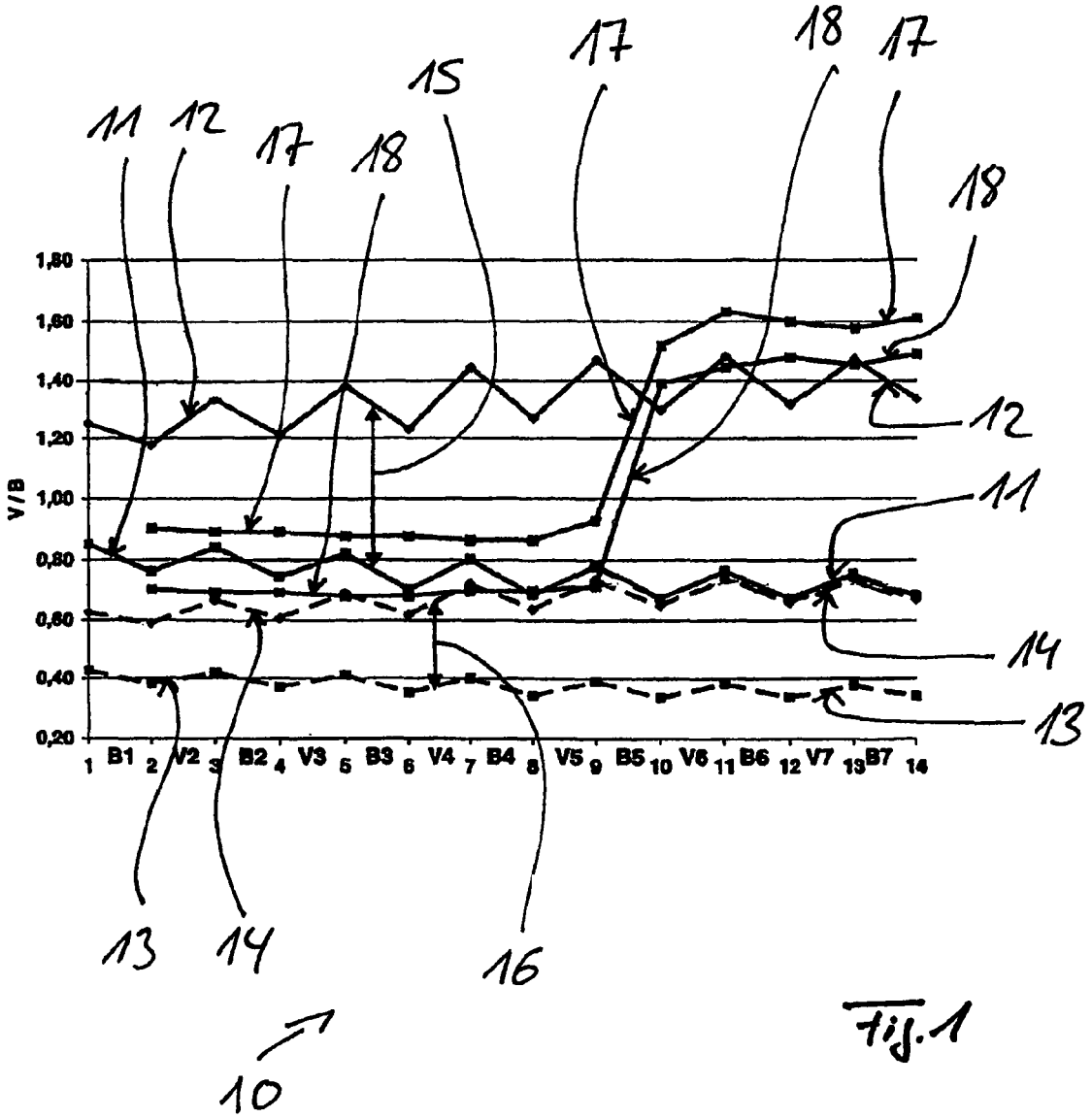
FIG. 1 shows a diagram for illustrating the design according to the present invention of the vane-to-blade ratio of the stages of a turbine with regard to modes k=−1 and k=−2 of the blade-passing frequency (BPF)

FIG. 1 shows a diagram 10 for a low-pressure turbine having a total of seven stages, six of the seven guide vane rings V2 through V7 and the seven moving blade rings B1 through B7 being plotted on the horizontal axis of diagram 10. The vane-to-blade ratio V/B is plotted on the vertical axis of diagram 10. Reference numeral 11 in FIG. 1 indicates a lower cut-off limit for mode k=−1 of the blade-passing frequency, while reference numeral 12 indicates the upper cut-off limit for mode k=−1 of this blade-passing frequency. Mode k=−1 of the blade-passing frequency (BPF) is dampened above upper cut-off limit 12 and below lower cut-off limit 11. However, in area 15, which is situated between lower cut-off limit 11 and upper cut-off limit 12 for mode k=−1 of the blade-passing frequency, mode k=−1 of the blade-passing frequency propagates almost undampened. Reference numeral 13 in FIG. 1 indicates a lower cut-off limit for mode k=−2 of the blade-passing frequency. Reference numeral 14 indicates the upper cut-off limit for mode k=−2 of the blade-passing frequency. Mode k=−2 thus propagates almost undampened in area 16 between lower cut-off limit 13 and upper cut-off limit 14 for mode k=−2 of the blade-passing frequency (BPF), proper dampening being achieved for mode k=−2 below lower cut-off limit 13 and above upper cut-off limit 14.

In the prior art, the vane-to-blade ratio of the downstream stages (V5 through B7) is selected in such a way that, for the downstream stages, it is above upper cut-off limit 12 for mode k=−1 of the blade-passing frequency. This is achieved according to the related art in that the vane-to-blade ratio V/B is established at a value of approximately 1.50 for these stages. In contrast, a vane-to-blade ratio V/B of approximately 0.90 is selected for the upstream stages (V2 through B4) according to the the present invention as shown by reference numeral 17. However, such a vane-to-blade ratio is within area 15 so that, according to the related art, sound waves at frequencies in the range of the blade-passing frequency (BPF) are not dampened in the upstream stages.

Figure 2:
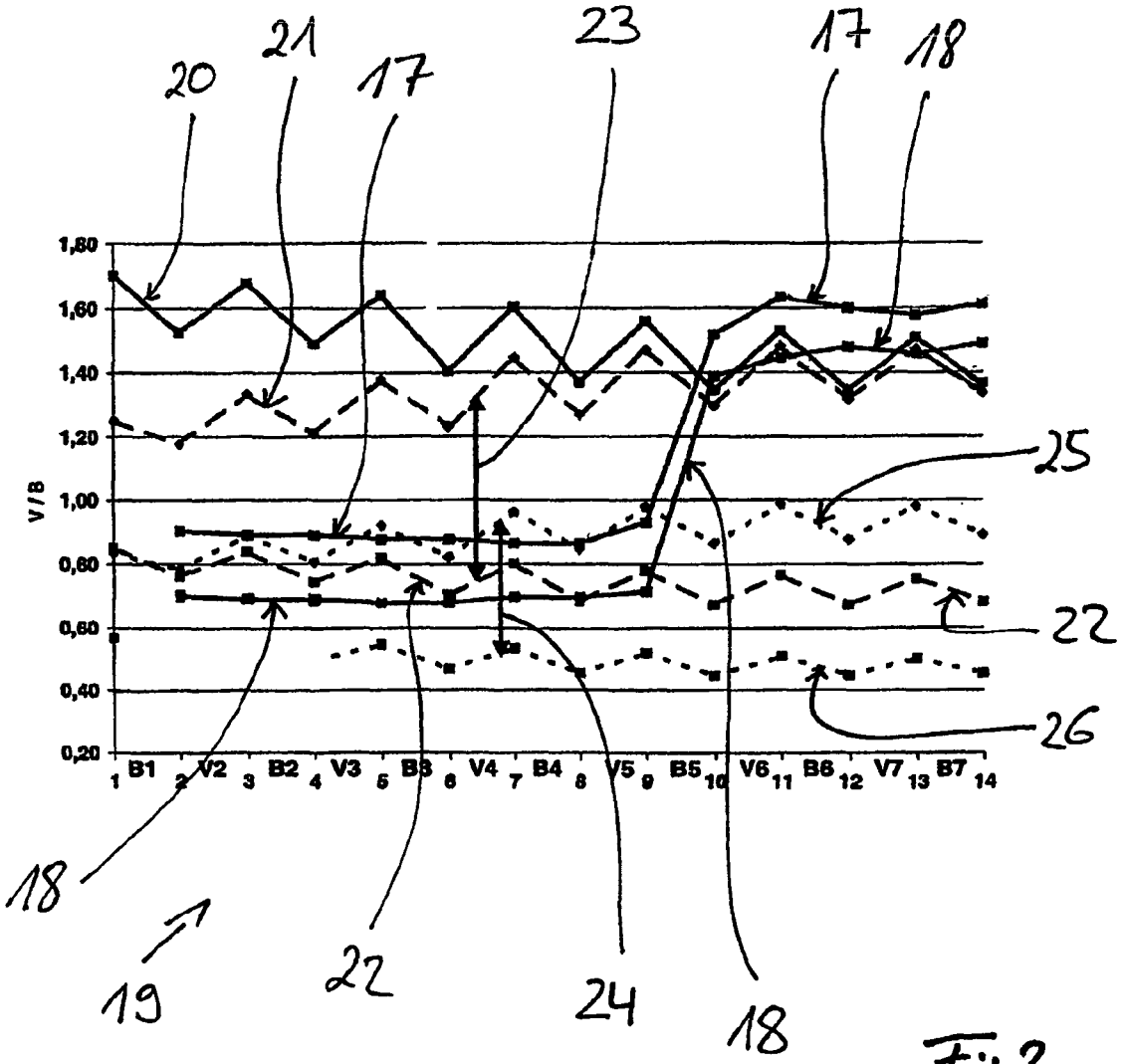
FIG. 2 shows a diagram for illustrating the design according to the present invention of the vane-to-blade ratio of the stages of a turbine with regard to modes k=−1, k=−2, and k=−3 of the double blade-passing frequency (2BPF).

Another problem of design principle 17 known from the related art arises from FIG. 2 in which the propagation characteristics and the dampening characteristics of modes k=−1, k=−2, and k=−3 of the double blade-passing frequency (2BPF) are discussed. Reference numeral 20 in diagram 19 of FIG. 2 indicates the lower cut-off limit for mode k=−1 of the double blade-passing frequency (2BPF). Reference numeral 21 in FIG. 2 indicates the upper cut-off limit for mode k=−2 of the double blade-passing frequency (2BPF) and reference numeral 22 in FIG. 2 indicates the lower cut-off limit for mode k=−2 of the double blade-passing frequency (2BPF). In the area 23 of FIG. 2, which is situated between upper cut-off limit 21 and lower cut-off limit 22 for mode k=−2 of the double blade-passing frequency (2BPF), mode k=−2 of the double blade-passing frequency (2BPF) propagates almost undampened. Moreover, a corresponding area 24 for mode k=−3 of the double blade-passing frequency (2BPF) is shown in FIG. 3 which is situated between an upper cut-off limit 25 and a lower cut-off limit 26 for mode k=−3 of the double blade-passing frequency.

Reference numeral 17 in FIG. 2 again indicates the design principle of the vane-to-blade ratio for the stages of the low-pressure turbine known from the related art. As is apparent from FIG. 2, for the design principle known from the related art, the vane-to-blade ratio V/B in the area of the downstream stages (V5 through B7) is situated above lower cut-off limit 20 for mode k=−1 of the double blade-passing frequency. According to the related art, mode k=−1 of the double blade-passing frequency is not dampened in the area of the downstream stages. Moreover, in the area of the upstream stages (V1 through B4), the vane-to-blade ratio V/B of these stages is in area 23, from which it follows that for these stages mode k=−2 of the double blade-passing frequency (2BPF) is not dampened.

A particularly preferred design principle for the vane-to-blade ratio for the stages of a low-pressure turbine is indicated with reference numeral 18 in FIGS. 1 and 2.

As is apparent in particular in FIG. 1, the upstream stages (V2 through B4) situated in the flow direction of the turbine are designed in such a way that their vane-to-blade ratio V/B under noise-critical operating conditions of the turbine is between the lower cut-off limit 11 for mode k=−1 of the blade-passing frequency (BPF) and upper cut-off limit 14 for mode k=−2 of the blade-passing frequency (BPF). In the area of these stages, the vane-to-blade ratio is preferably in a range between 0.6 and 0.8, in particular in a range of approximately 0.7. In the area of the upstream stages, the vane-to-blade ratio V/B is thus established in a window between lower cut-off limit 11 of mode k=−1 of the blade-passing frequency and upper cut-off limit 14 of mode k=−2 of the blade-passing frequency. Modes k=−1 and k=−2 of the blade-passing frequency (BPF) are thus properly dampened in the area of these stages.

In the area of the downstream stages (V5 through B7) of the low-pressure turbine, their vane-to-blade ratio is established in a range above upper cut-off limit 12 of mode k=−1 of the blade-passing frequency, according to FIG. 1. Moreover, the vane-to-blade ratio for these stages is selected in such a way that, in the area of these stages, it is between lower cut-off limit 20 of mode k=−1 and upper cut-off limit 21 of mode k=−2 of the double blade-passing frequency (2BPF), according to FIG. 2. This is achieved in that the vane-to-blade ratio V/B in the area of the downstream stages of the turbine assumes a value which is in a range between 1.3 and 1.5, preferably approximately 1.4.

Furthermore, it is apparent from FIG. 2 that due to the vane-to-blade ratio V/B for the upstream stages (V2 through B4), already discussed in connection with FIG. 1, which is preferably in a range between 0.6 and 0.8, it may be achieved that it is outside of area 23 in which mode k=−2 of the double blade-passing frequency (2BPF) may propagate almost undampened. Moreover, the less critical mode k=−3 of the double blade-passing frequency (2BPF) is positioned in area 23 for these stages.

The above-described design principle for the vane-to-blade ratio of the stages of a low-pressure turbine directly results in that, using the present invention, modes k=−1 and k=−2 of the blade-passing frequency (BPF) and modes k=−1 and k=−2 of the double blade-passing frequency (2BPF) may be dampened. A turbine configured in this way is thus characterized by low sound emission of frequencies in the range of the blade-passing frequency and the double blade-passing frequency. Using the present invention makes it possible to design all stages of a low-pressure turbine in such a way that the low-pressure turbine exhibits an optimal noise performance.

As mentioned above, FIGS. 1 and 2 only show a preferred exemplary embodiment of the present invention. It should be pointed out that, based on the present invention, it is of course possible to select the vane-to-blade ratio for all stages of the low-pressure turbine in such a way that it is between a lower cut-off limit for mode k=−1 of the blade-passing frequency (BPF) of the respective stage and an upper cut-off limit for mode k=−2 of the blade-passing frequency (BPF) of the respective stage.

It is also possible to determine the vane-to-blade ratio for the upstream stages in such a way that, for the upstream stages, it is between a lower cut-off limit for mode k=−1 of the double blade-passing frequency (2BPF) and an upper cut-off limit for mode k=−2 of the double blade-passing frequency (2BPF), while the vane-to-blade ratio for the downstream stages is between a lower cut-off limit for mode k=−1 of the blade-passing frequency (BPF) and an upper cut-off limit for mode k=−2 of the blade-passing frequency (BPF). Also proper dampening of the sound propagation and thus a noise minimization of the low-pressure turbine is possible in low-pressure turbines designed in this way.

What is claimed is:

1. A turbine, comprising:

a plurality of stages positioned axially one behind the other in the flow direction of the turbine, each stage being formed by a stationary guide vane ring having multiple guide vanes and a rotating blade ring having multiple rotating blades, and each stage having a vane-to-blade ratio characteristic quantity indicating a number of guide vanes to the number of rotating blades ratio within a stage;

at least one stage of the plurality of stages of the turbine being designed so that under noise-critical operating conditions of the turbine, the vane-to-blade ratio characteristic quantity of the one stage is between a lower cut-off limit for the mode k=−1 of the blade-passing frequency of the one stage and an upper cut-off limit for the mode k=−2 of the blade-passing frequency of the one stage.

2. The turbine as recited in claim 1, wherein the one stage is an upstream stage.

3. The turbine as recited in claim 2, wherein the upstream stage has a vane-to-blade ratio characteristic quantity of between 0.6 and 0.8.

4. The turbine as recited in claim 3, wherein the vane-to-blade ratio characteristic quantity of the upstream stage is 0.7.

5. The turbine as recited in claim 1, wherein a further stage of the turbine is designed in such a way that its vane-to-blade ratio characteristic quantity is between a lower cut-off limit for the mode k=−1 of the double blade-passing frequency of the further stage and an upper cut-off limit for the mode k=−2 of the double blade-passing frequency of the further stage under noise-critical operating conditions of the turbine.

6. The turbine as recited in claim 5, wherein the further stage is a downstream stage.

7. The turbine as recited in claim 6, wherein a vane-to-blade ratio characteristic quantity of the downstream stage is between 1.3 and 1.5.

8. The turbine as recited in claim 7, wherein the vane-to-blade ratio characteristic quantity of the downstream stage is 1.4.

9. The turbine as recited in claim 6, wherein the upstream stages of the turbine positioned in the flow direction are designed in such a way that the vane-to-blade ratio characteristic quantities of the upstream stages are between 0.6 and 0.8, and the downstream stages of the turbine positioned in the flow direction are designed in such a way that the vane-to-blade ratio characteristic quantities of the downstream stages are between 1.3 and 1.5.

10. The turbine as recited in claim 9, wherein the vane-to-blade ratio characteristic quantities of the upstream stages are 0.7 and the vane-to-blade ratio characteristic quantities of the downstream stages are 1.4.

11. The turbine as recited in claim 1, wherein the upstream stages of the turbine positioned in the flow direction are designed in such a way that under noise-critical operating conditions of the turbine their vane-to-blade ratio characteristic quantity is between the lower cut-off limit for the mode k=−1 of the blade-passing frequency and the upper cut-off limit for the mode k=−2 of the blade-passing frequency and the downstream stages of the turbine positioned in the flow direction are designed in such a way that under noise-critical operating conditions of the turbine the vane-to-blade ratio characteristic quantity is between a lower cut-off limit for the mode k=−1 of the double blade-passing frequency and an upper cut-off limit for the mode k=−2 of the double blade-passing frequency.

12. The turbine as recited in claim 1, wherein the turbine is a low pressure turbine of a gas turbine.

13. The turbine as recited in claim 12, wherein the turbine is a turbine of an aircraft engine.

* * * * *